US009144890B2

(12) United States Patent
Chen

(10) Patent No.: US 9,144,890 B2
(45) Date of Patent: Sep. 29, 2015

(54) BAR CLAMP HAVING A RATCHET MECHANISM FOR FASTENING A CLAMPED WORK PIECE

(71) Applicant: Chung Li Chen, Taichung (TW)

(72) Inventor: Chung Li Chen, Taichung (TW)

( * ) Notice: Subject to any disclaimer, the term of this patent is extended or adjusted under 35 U.S.C. 154(b) by 172 days.

(21) Appl. No.: 14/135,584

(22) Filed: Dec. 20, 2013

(65) Prior Publication Data

US 2015/0174737 A1 Jun. 25, 2015

(51) Int. Cl.

| | |
|---|---|
| ***B25B 5/08*** | (2006.01) |
| ***B25B 5/06*** | (2006.01) |
| ***B25B 5/16*** | (2006.01) |

(52) U.S. Cl.

CPC ..... *B25B 5/085* (2013.01); *B25B 5/068* (2013.01); *B25B 5/163* (2013.01)

(58) Field of Classification Search

CPC ..... B25B 1/06; B25B 1/12; B25B 1/16; B25B 1/24; B25B 1/2468; B25B 13/22; B25B 13/46; B25B 5/068; B25B 5/085; B25B 5/163

See application file for complete search history.

(56) References Cited

U.S. PATENT DOCUMENTS

| | | | | | |
|---|---|---|---|---|---|
| 63,929 | A * | 4/1867 | Morse | 269/223 |
| 782,274 | A * | 2/1905 | Reisinger | 81/356 |
| 1,112,192 | A * | 9/1914 | Callan | 269/221 |
| 1,320,230 | A * | 10/1919 | Homrighausen | 81/314 |
| 2,504,373 | A * | 4/1950 | Andrews et al. | 269/210 |
| 2,566,072 | A * | 8/1951 | Snell | 269/213 |
| 2,619,138 | A * | 11/1952 | Marler | 81/382 |
| 5,454,551 | A * | 10/1995 | Hobday | 269/6 |
| 6,648,314 | B1 * | 11/2003 | Degen et al. | 269/6 |
| 7,040,609 | B1 * | 5/2006 | Liou | 269/6 |
| 7,530,556 | B1 * | 5/2009 | Zheng | 269/6 |
| 2006/0043660 | A1 * | 3/2006 | Ping | 269/6 |
| 2008/0136077 | A1 * | 6/2008 | Yang | 269/6 |

* cited by examiner

*Primary Examiner* — Lee D Wilson
*Assistant Examiner* — Tyrone V Hall, Jr.

(57) ABSTRACT

A bar clamp having a ratchet for fastening a clamped work piece is provided with a fixed jaw carrier at a front end of a slide bar; a moveable jaw carrier moveably put on the slide bar and including a transverse channel distal the slide bar, and a gear adjacent to the channel; a shaft partially disposed in the channel and including two parallelepiped ends; two cam members each including a rectangular hole complimentarily put on one parallelepiped end; a control lever including two fitting members disposed in tunnels and each including a rectangular hole complimentarily put on one parallelepiped end, a pivot hole, and a pin; a ratchet assembly including a spring actuated trigger mounted on the control lever, and a link secured to the trigger and including a pawl member in gear engagement with the gear; and a bifurcation member including two opposite curved slots.

1 Claim, 5 Drawing Sheets

BAR CLAMP HAVING A RATCHET MECHANISM FOR FASTENING A CLAMPED WORK PIECE

BACKGROUND OF THE INVENTION

1. Field of the Invention

The invention relates to bar clamps and more particularly to a bar clamp having a ratchet mechanism for fastening a clamped work piece.

2. Description of Related Art

A conventional bar clamp comprises a handgrip; a fixed jaw carrier; a slide bar comprising two opposite wing members; a moveable jaw carrier comprising a transverse channel, a trough extending from a center of the channel to one end of the channel, a bottom recess, and two opposite stop members in the recess wherein the slide bar passes the channel with the wing members being stopped by the trough in a locked position; and a U-shaped spring-actuated lock assembly in the recess and comprising inverted U-shaped opposite first and second lock members being engaged with the wing members in the locked position, and first and second projections between the lock members and a bottom of the lock assembly and being engaged with the stop members in the locked position. Pushing the locking assembly until being stopped will disengage the lock members from the wing members.

Notwithstanding the prior art, the invention is neither taught nor rendered obvious thereby.

SUMMARY OF THE INVENTION

It is therefore one object of the invention to provide a bar clamp comprising a slide bar; a fixed jaw carrier disposed at a front end of the slide bar; a moveable jaw carrier moveably put on the slide bar and including a transverse channel distal the slide bar, and a gear adjacent to the channel; a shaft partially disposed in the transverse channel and including two parallelepiped ends; two cam members each including a rectangular hole complimentarily put on one of the parallelepiped ends; a control lever including a tunnel at one end, and two plate shaped fitting members complimentarily disposed in the tunnels, each of the fitting members including a rectangular hole complimentarily put on one of the parallelepiped ends, a pivot hole, and a pin; a ratchet assembly including a spring actuated trigger mounted on the control lever, and a link secured to the spring actuated trigger, the link including a pawl member in gear engagement with the gear; and a bifurcation member including two opposite curved slots; wherein the pins pass the holes into the curved slots to slidably dispose therein; wherein a portion of the control lever, the shaft, the cam members, and a portion of the moveable jaw carrier are disposed in the bifurcation member; wherein a pivotal movement of the control lever rotates both the shaft and the cam members in the same direction; wherein a pressing of the spring actuated trigger disengages the pawl member from the gear, a pivotal downward movement of the control lever clockwise turns the cam members which in turn push the bifurcation member toward the fixed jaw carrier, and a release of the spring actuated trigger engages the pawl member with the gear; and wherein a pressing of the spring actuated trigger disengages the pawl member from the gear, a pivotal upward movement of the control lever counterclockwise turns the cam members which in turn move the bifurcation member away from the fixed jaw carrier, and a release of the spring actuated trigger engages the pawl member with the gear.

The above and other objects, features and advantages of the invention will become apparent from the following detailed description taken with the accompanying drawings.

DETAILED DESCRIPTION OF THE INVENTION

Figure 1:
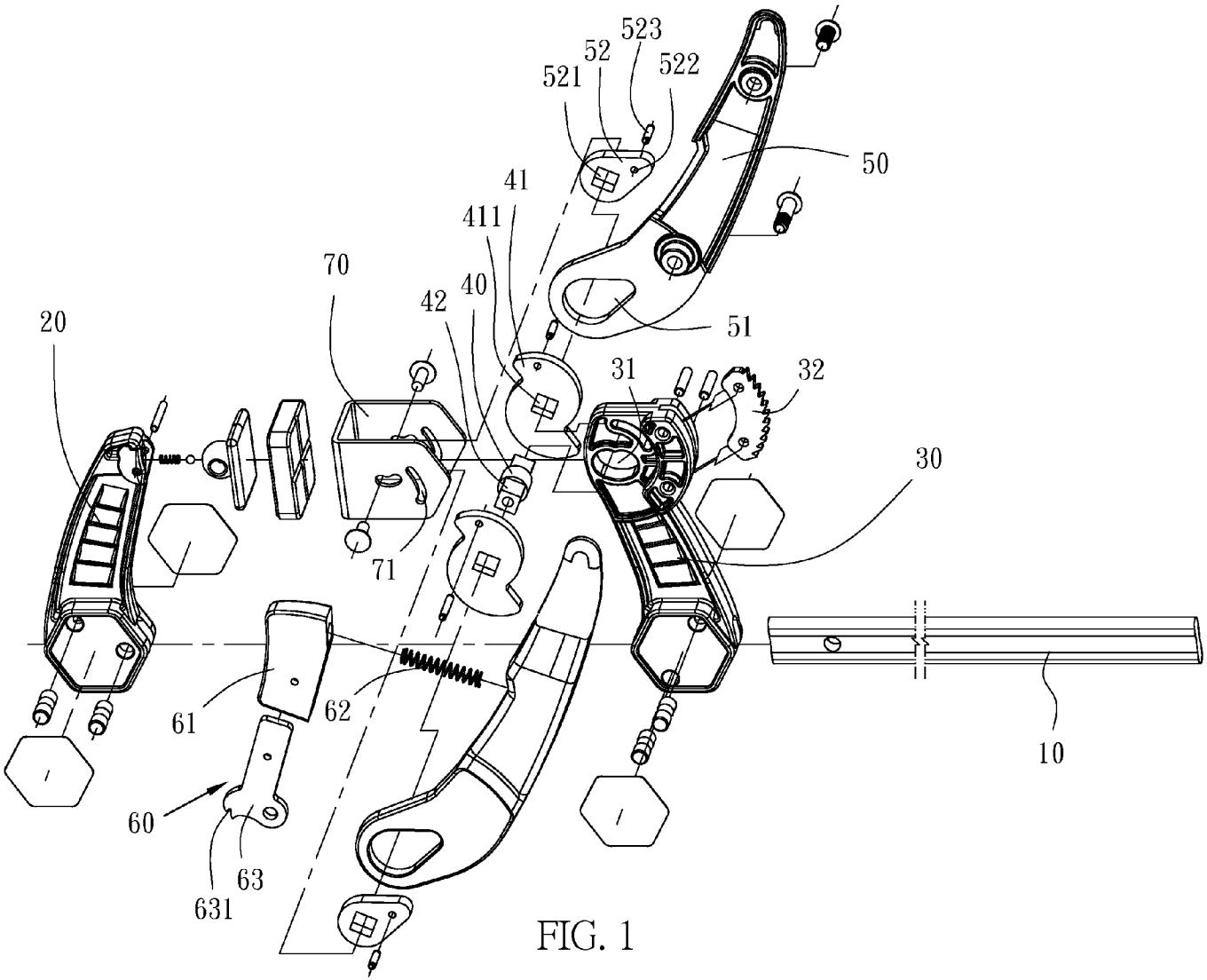
FIG. 1 is an exploded view of a bar clamp according to the invention.

Referring to FIGS. 1 to 5, a bar clamp in accordance with the invention comprises the following components as discussed in detail below.

A slide bar 10 has a forward end provided with a fixed jaw carrier 20. A moveable jaw carrier 30 has a hollow lower portion moveably put on the slide bar 10. The moveable jaw carrier 30 comprises a transverse channel 31 at an end distal the slide bar 10, and a gear 32 adjacent to the channel 31. A shaft 40 is partially disposed in the channel 31 and has two parallelepiped ends 42. Two cam members 41 each have a square hole 411 complimentarily put on the parallelepiped end 42.

A control lever 50 is shaped as an elongated, oval plate and comprises a tunnel 51 at one end, and two plate shaped fitting members 52 fitted in the tunnels 51. The fitting member 52 includes a square hole 521 complimentarily put on the parallelepiped end 42, a pivot hole 522, and a pin 523. A ratchet assembly 60 comprises a trigger 61, a spring 62 biased between the trigger 61 and the control lever 50, and a link 63 secured to the trigger 61 and including a pawl member 631 in gear engagement with the teeth of the gear 32. A bifurcation member 70 comprises two opposite curved slots 71. The pins 523 pass the holes 522 into the slots 71 to be adapted to slide therein. The lower portions of the control lever 50, the shaft 40, the cam members 41, and an upper portion of the moveable jaw carrier 30 are disposed in the bifurcation member 70. A pivotal movement of the control lever 50 can rotate the shaft 40 in the same direction. Further, the cam members 41 rotates in the same direction as the shaft 40.

Figure 3:
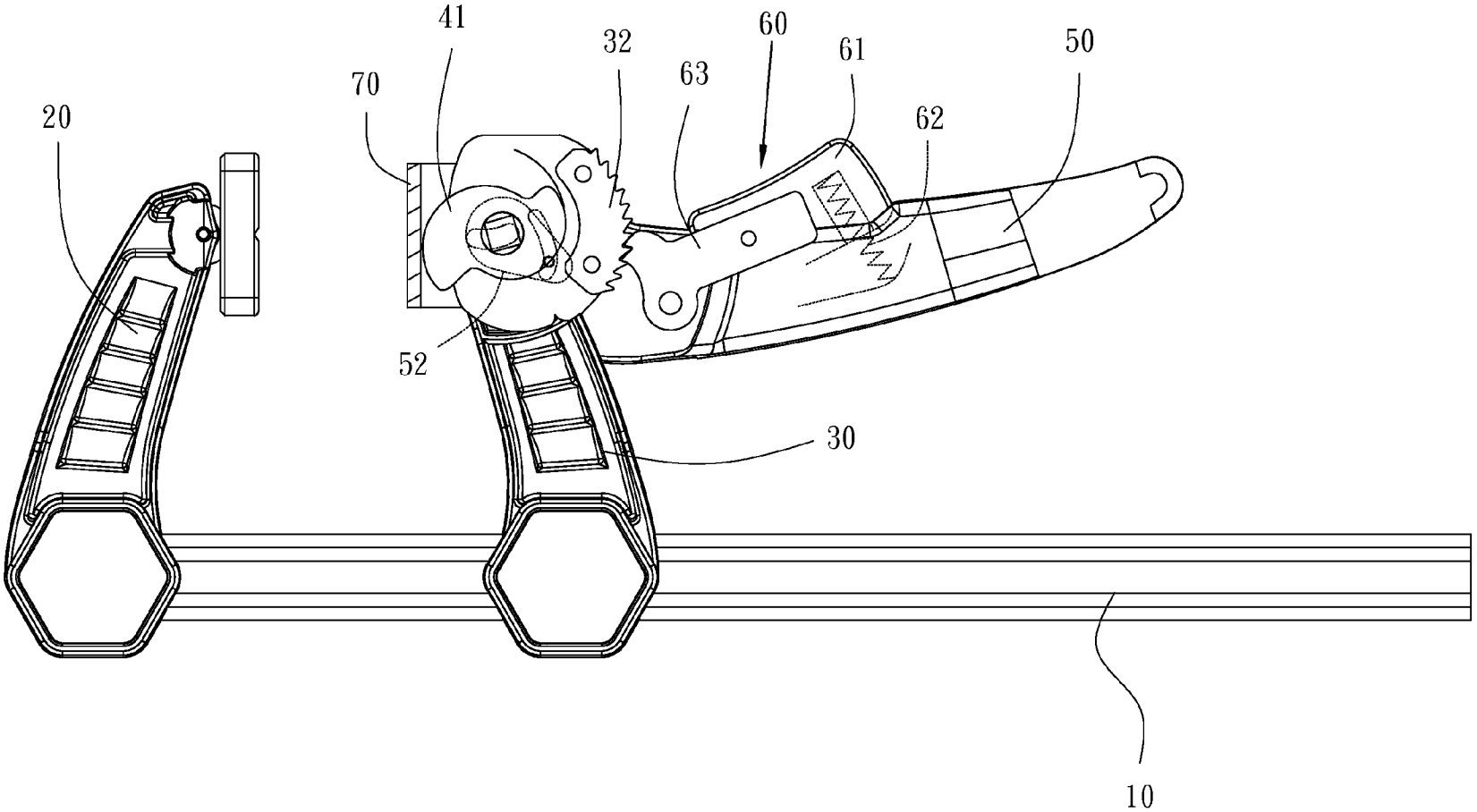
FIG. 3 is a view similar to FIG. 2 showing a locking operation of the bar clamp.

As shown in FIG. 3, a pressing of the trigger 61 can disengage the pawl member 631 from the gear 32. Next, a pivotal downward movement of the control lever 50 may clockwise turn the cam members 41 which in turn push the bifurcation member 70 toward the fixed jaw carrier 20 to clamp a work piece between the fixed jaw carrier 20 and the moveable jaw carrier 30. Further, a release of the trigger 61 causes the pawl member 631 to engage the last two teeth of the gear 32 to secure the clamping.

Figure 2:
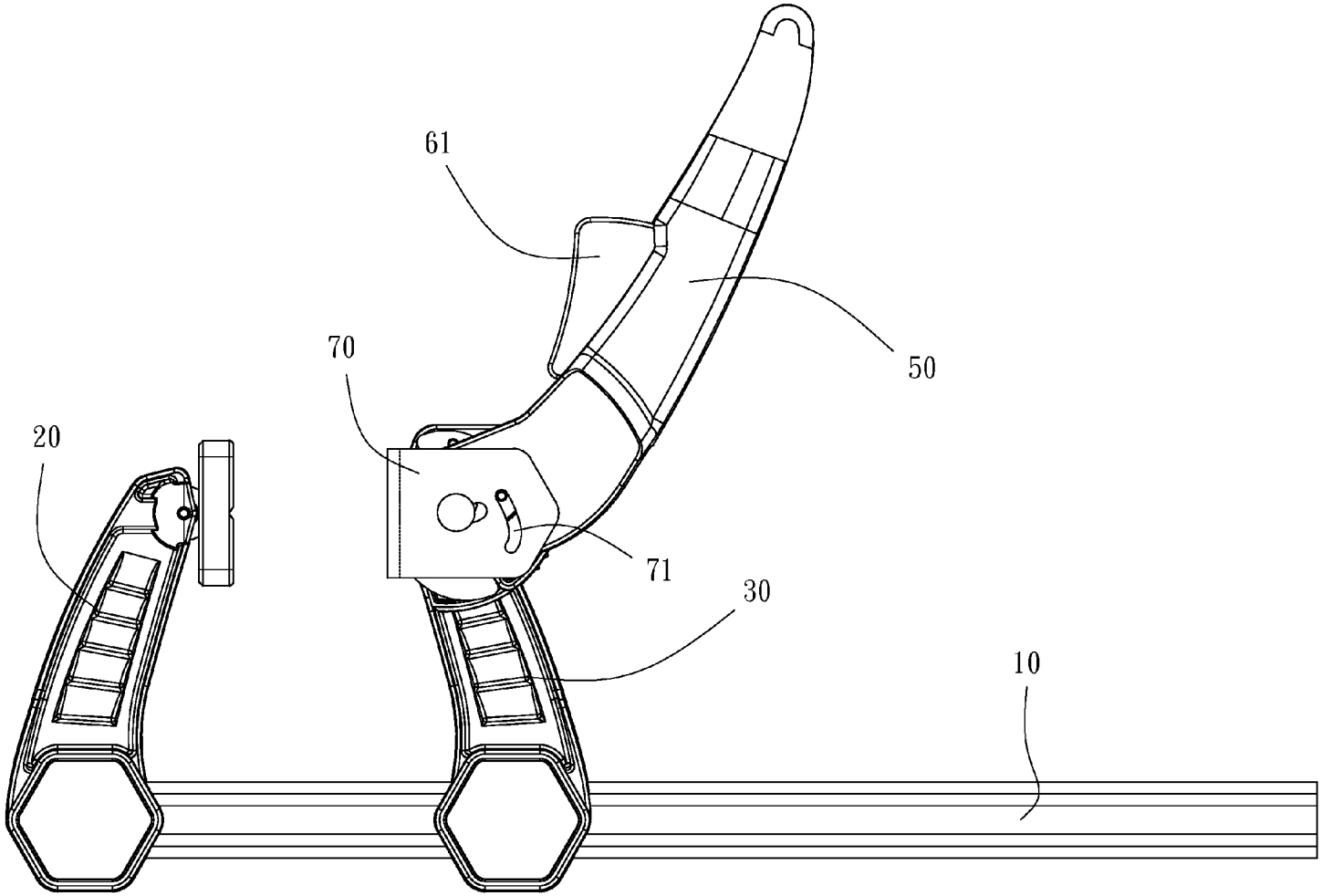
FIG. 2 is side elevation of the assembled bar clamp of FIG. 1.
Figure 4:
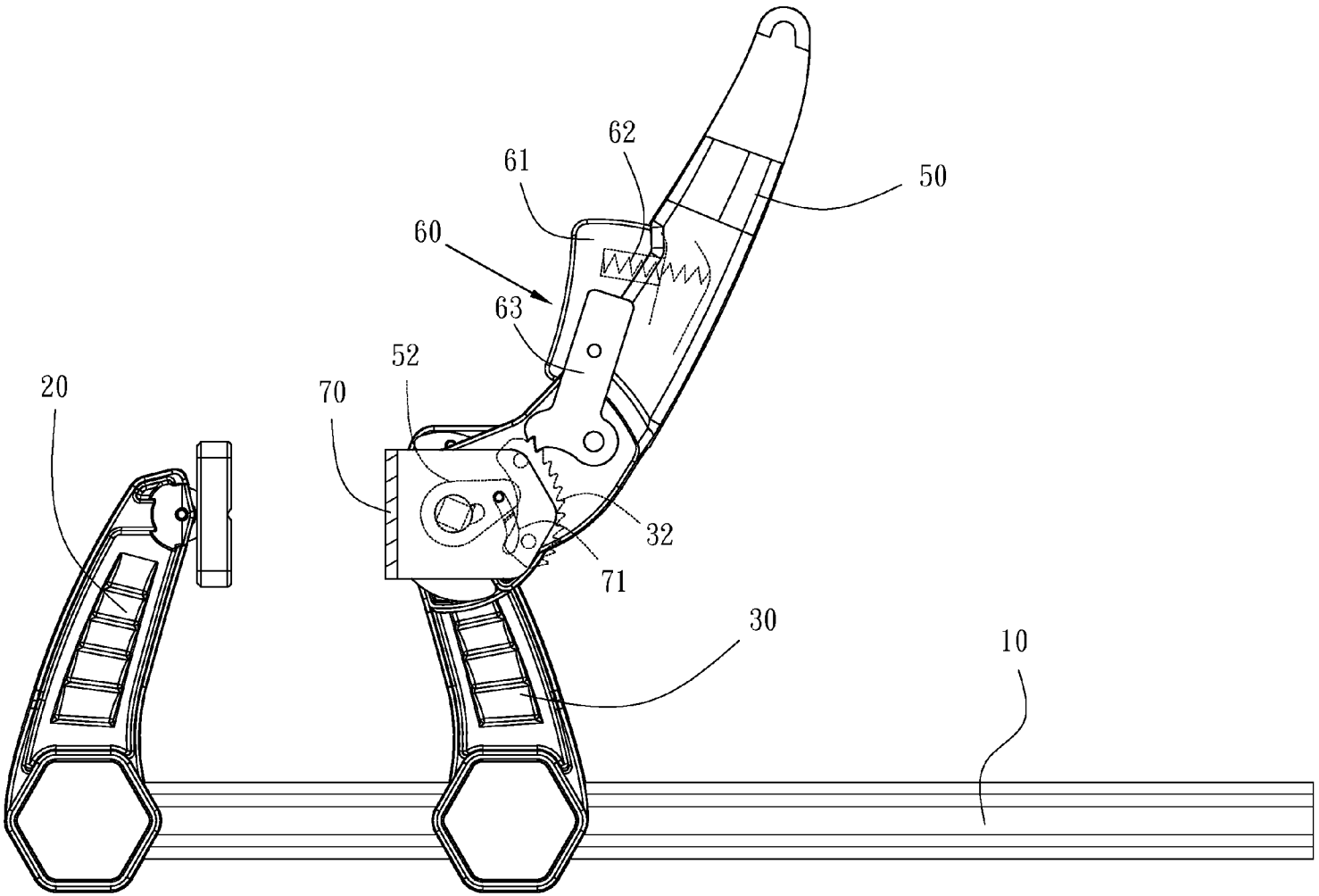
FIG. 4 is a view similar to FIG. 2 showing an unlocking operation of the bar clamp.
Figure 5:
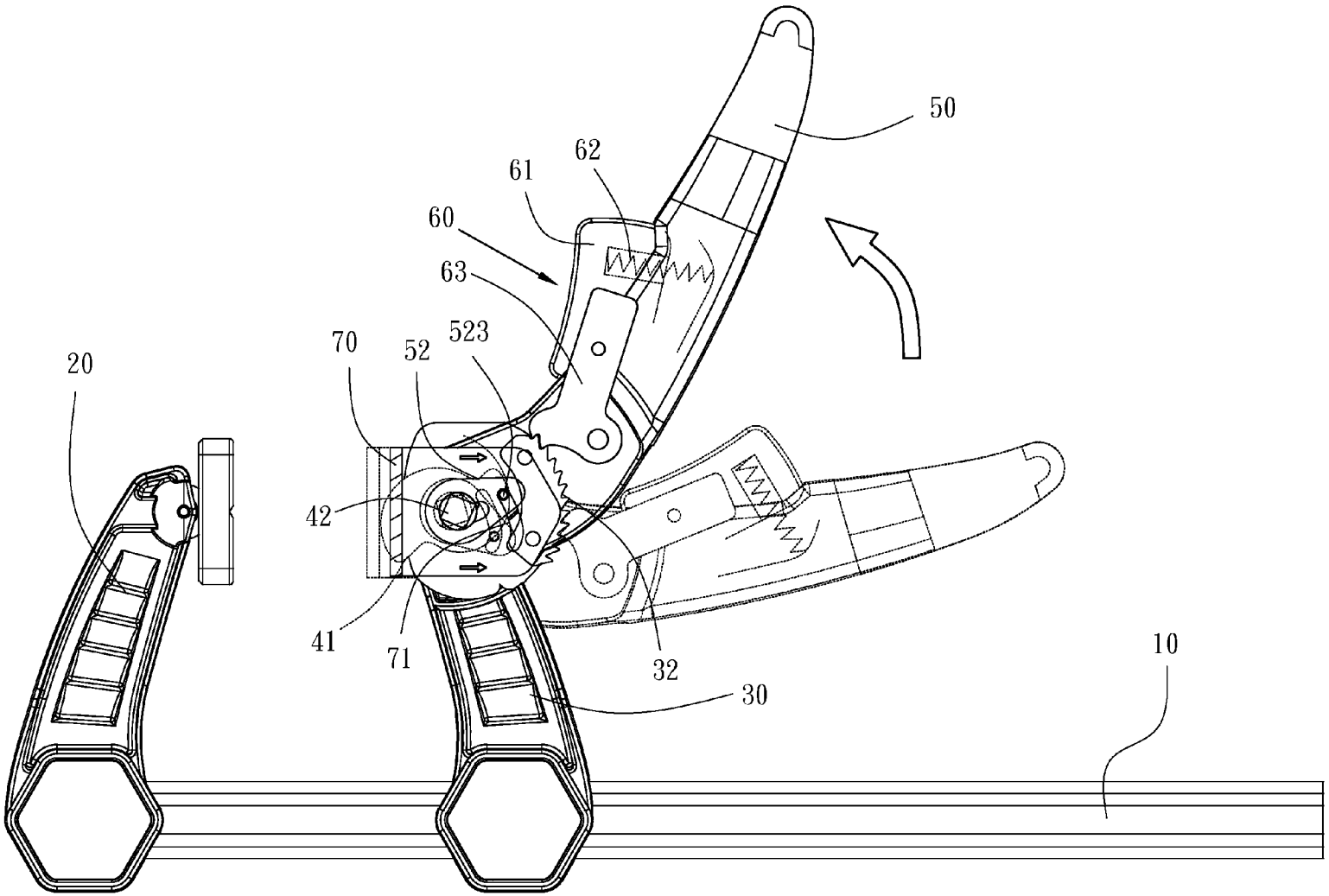
FIG. 5 is a view similar to FIG. 2 showing a returning operation of the bifurcation member.

As shown in FIGS. 2, 4, and 5, a pressing of the trigger 61 can disengage the pawl member 631 from the gear 32. Next, a pivotal upward movement of the control lever 50 may counterclockwise turn the cam members 41 which in turn move the bifurcation member 70 away from the fixed jaw carrier 20 to unfasten the work piece between the fixed jaw carrier 20 and the moveable jaw carrier 30. At the same time, the pawl member 631 moves along the teeth of the gear 32 in a spaced manner. Also, the pins 523 move to upper ends of the slots 71 to be stopped there. Finally, a release of the trigger 61 causes the pawl member 631 to engage the last two teeth of the gear 32. Also, the moveable jaw carrier 30 is returned to an inoperative position.

While the invention has been described in terms of preferred embodiments, those skilled in the art will recognize that the invention can be practiced with modifications within the spirit and scope of the appended claims.

What is claimed is:

1. A bar clamp comprising:

a slide bar;

a fixed jaw carrier disposed at a front end of the slide bar;

a moveable jaw carrier moveably put on the slide bar and including a transverse channel distal the slide bar, and a gear adjacent to the channel;

a shaft partially disposed in the transverse channel and including two parallelepiped ends;

two cam members each including a rectangular hole complimentarily put on one of the parallelepiped ends;

a control lever including a tunnel at one end, and two plate shaped fitting members complimentarily disposed in the tunnels, each of the fitting members including a rectangular hole complimentarily put on one of the parallelepiped ends, a pivot hole, and a pin;

a ratchet assembly including a spring actuated trigger mounted on the control lever, and a link secured to the spring actuated trigger, the link including a pawl member in gear engagement with the gear; and a bifurcation member including two opposite curved slots;

wherein the pins pass the pivot holes into the curved slots to slidably dispose therein;

wherein a portion of the control lever, the shaft, the cam members, and a portion of the moveable jaw carrier are disposed in the bifurcation member;

wherein a pivotal movement of the control lever rotates both the shaft and the cam members in the same direction;

wherein a pressing of the spring actuated trigger disengages the pawl member from the gear, a pivotal downward movement of the control lever clockwise turns the cam members which in turn push the bifurcation member toward the fixed jaw carrier, and a release of the spring actuated trigger engages the pawl member with the gear; and wherein a pressing of the spring actuated trigger disengages the pawl member from the gear, a pivotal upward movement of the control lever counterclockwise turns the cam members which in turn move the bifurcation member away from the fixed jaw carrier, and a release of the spring actuated trigger engages the pawl member with the gear.

* * * * *